United States Patent [19]

Mukunoki et al.

[11] Patent Number: 4,847,186

[45] Date of Patent: Jul. 11, 1989

[54] SILVER HALIDE PHOTOGRAPHIC LIGHT-SENSITIVE MATERIALS

[75] Inventors: Yasuo Mukunoki; Yukio Maekawa, both of Kanagawa, Japan

[73] Assignee: Fuji Photo Film Co., Ltd., Kanagawa, Japan

[21] Appl. No.: 57,718

[22] Filed: Jun. 1, 1987

Related U.S. Application Data

[63] Continuation of Ser. No. 796,459, Nov. 8, 1985, abandoned.

[30] Foreign Application Priority Data

Nov. 9, 1984 [JP] Japan ..... 59-236390

[51] Int. Cl.[4] ..... G03C 1/38

[52] U.S. Cl. ..... 430/523; 430/631; 430/635; 430/636

[58] Field of Search ..... 430/631, 635, 636, 523

[56] References Cited

U.S. PATENT DOCUMENTS

| | | | |
|---|---|---|---|
| 3,754,924 | 8/1973 | De Geest et al. | 430/635 |
| 4,242,444 | 12/1980 | Habu et al. | 430/635 |
| 4,267,265 | 5/1981 | Sugimoto et al. | 430/631 |
| 4,385,110 | 5/1983 | Yoneyama et al. | 430/636 |

*Primary Examiner*—Richard L. Schilling
*Attorney, Agent, or Firm*—Sughrue, Mion, Zinn, Macpeak & Seas

[57] ABSTRACT

A silver halide photographic light-sensitive material comprising a support and at least one silver halide emulsion layer, wherein at least one of said emulsion layers or another layers which constitutes said material contains a surface active agent represented by the following general formula:

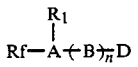

wherein Rf represents a saturated or unsaturated hydrocarbon group having 3 to 24 carbon atoms wherein all or a part of hydrogen atoms is substituted by a fluorine atom, $R_1$ represents a substituted or unsubstituted saturated or unsaturated hydrocarbon group having 4 to 24 carbon atoms, A represents a trivalent bonding group, B represents a divalent group having an ether bond, D represents a hydrophilic group, and n represents an integer of 2 to 100.

14 Claims, No Drawings

SILVER HALIDE PHOTOGRAPHIC LIGHT-SENSITIVE MATERIALS

This is a continuation of application Ser. No. 06/796,459, filed Nov. 8, 1985, now abandoned.

FIELD OF THE INVENTION

The present invention relates to silver halide photographic light-sensitive materials having good antistatic property and, particularly, to silver halide photographic light-sensitive materials (hereinafter, referred to as "photographic light-sensitive materials") which cause less static electricity by various materials, wherein the antistatic property does not change with the passage of time.

BACKGROUND OF THE INVENTION

Since photographic light-sensitive materials are generally composed of an electrically insulating support and photographic layers, static electric charges are frequently accumulated in the step of preparing the photographic light-sensitive materials and during their use by contact friction between the surfaces of the same or different kinds of material or by subjecting to separation. The accumulated static electric charges cause various troubles. The most serious trouble is that the static electric charges accumulated prior to development processing are discharged so as to expose the light-sensitive emulsion layers to light, whereby dot spots or branched or feathery linear specks are formed upon development processing of the photographic films. This phenomenon, which is called static marks, greatly damages the value of photographic films and, in some cases, the value is entirely lost. For example, in the case of medical or industrial X-ray films, it is easily understood that such a phenomenon can bring about a misdiagnosis. In the case of color photographic light-sensitive materials, momentous recollections can be ruined. This phenomenon is a very troublesome problem because it is found for the first time upon development. Further, the accumulated static electric charges induce secondary problems, for example, dust adheres to the surface of the films or a uniform coating cannot be obtained.

Such static electric charges are frequently accumulated during the preparation or use of the photographic light-sensitive materials as described above. For example, in the step of preparation, they are generated by contact friction between the photographic film and a roller or by separation of the emulsion face from the support face in the step of winding and rewinding of the photographic films. In the finished products, they are generated by separation of the emulsion face from the base face in the case of conducting exchange of the winding operation of the photographic film or by contact or separation of the X-ray film with or from machine parts or fluorescent sensitizing paper in an automatic camera.

In color negative films and color reversal films, they are generated by contact with or separation from rollers or bars made of rubber, metal, plastic, etc., in the camera or the bonding machine or automatic developing machine in the development shops.

In addition, they are generated by contact with packing materials, etc. Generation of static marks on photographic light-sensitive materials which are induced by accumulation of such static electric charges becomes remarkable with an increase of the sensitivity of the photographic light-sensitive materials and an increase of the processing rate thereof. Particularly, in recent years, static marks are easily generated because the photographic light-sensitive materials have high sensitivity and they are frequently subjected to severe handling such as high rate coating, high rate photographing or high speed automatic development processing, etc.

In order to remove these problems caused by static electricity, it is preferred to add antistatic agent to the photographic light-sensitive materials. However, antistatic agents generally used in other fields cannot always be used as antistatic agents for photographic light-sensitive materials, and they are subject to various restrictions characteristic of photographic light-sensitive materials. Namely, antistatic agents capable of being utilized for photographic light-sensitive materials are required to have not only an excellent antistatic property but also excellent performances, for example, they do not have a bad influence upon the photographic characteristics, such as sensitivity, fog, granularity, sharpness, etc., of the photographic light-sensitive materials, they do not have a bad influence upon the film strength of the photographic light-sensitive materials (namely, scratches are not easily formed by friction or scratching), they do not have a bad influence upon adhesion resistance (namely, surfaces of photographic light-sensitive materials are not easily adhered to each other or to the surface of other materials), they do not accelerate fatigue of the processing solutions for the photographic light-sensitive materials, they do not pollute conveying rollers, they do not deteriorate the adhesion strength between each constituent layer in the photographic light-sensitive materials, and the like. Thus, antistatic agents are subject to many restrictions in order to be useful with photographic light-sensitive materials.

One way for removing problems caused by static electricity is to increase the electric conductivity of the surface of the light-sensitive materials so that static electric charges are scattered and lost within a short time before the accumulated charges are discharged.

Accordingly, processes for improving the electric conductivity of the support of the photograhic light-sensitive materials or coated surface layers thereof have been proposed hitherto, and utilization of various hygroscopic substances or water-soluble inorganic salts, certain kinds of surface active agent, polymers, etc., have been attempted. For example, polymers as described in U.S. Pat. Nos. 2,882,157, 2,972,535, 3,062,785, 3,262,807, 3,514,291, 3,615,531, 3,753,716 and 3,938,999, etc., surface active agents as described in U.S. Pat. Nos. 2,982,651, 3,428,456, 3,457,076, 3,454,625, 3,552,972 and 3,655,387, etc., metal oxides and colloidal silica as described in U.S. Pat. Nos. 3,062,700, 3,245,833 and 3,525,621, and the like have been known.

However, many of these substances show specificity according to the kind of film support or difference of photographic constituent elements, and they produce a good result for a certain kind of film support and photographic emulsion or other photographic constituent elements, but they are useless for preventing electrification in another film support and photographic constituent elements and also have a bad influence upon the photographic properties.

On the other hand, there are many cases that they show very excellent antistatic effects, but they cannot be used because they have a bad influence upon the photographic characteristics such as sensitivity, fog, granularity, sharpness, etc., of the photographic emulsions. For example, polyethylene oxide type compounds are well known to have an antistatic effect, but they often have a bad influence upon the photographic characteristics such as an increase of fog, desensitization, deterioration of granularity, etc. Particularly, in the sensitive materials wherein both sides of the support are coated with a photographic emulsion, such as medical direct X-ray sensitive materials, it is very difficult to establish a technique of effectively giving the antistatic property without having a bad influence upon the photographic characteristics. As described above, it is very difficult to apply antistatic agents to the photographic light-sensitive materials, and the extent of their use is often restricted.

A further way of removing the problems of the photographic light-sensitive materials caused by static electricity is to lower the electricity generation of the surface of light-sensitive materials so that generation of static electricity caused by friction or contact as described above becomes small.

For example, fluorine containing surface active agents as described in British Pat. Nos. 1,330,356 and 1,524,631, U.S. Pat. Nos. 3,666,478 and 3,589,906, Japanese Patent Publication No. 26687/77, and Japanese Patent Applications (OPI) Nos. 46733/74, 32322/76, 84712/78 and 14224/79 (the term "OPI" as used herein refers to a "published unexamined Japanese patent application"), have been used for the photographic light-sensitive materials for the above described purpose.

However, photographic light-sensitive materials containing these fluorine containing surface active agents have a static electric characteristic of, generally, negatively charging by various materials contacting therewith. Though it is possible to control the electricity generation caused by a rubber roller, Delrin (trade name of E. I. Dupont, formaldehyde polymer) roller, nylon bar, etc., contacting therewith so as to be small by combining them with a coating agent having a positively charging property to such materials, the fluorine containing surface active agents still have difficulty in reducing the electricity generation for all materials. For example, in the case of reducing the electricity generation for rubber, a branched static mark is generally formed by Delrin, etc., which is situated on a more positive position in the electrification series. In contrast with this, in the case of reducing electricity generation for Delrin, a spot static mark is generally formed by rubber, etc., which is situated on a more negative position in the electrification series. In order to compensate these cases, there is a process wherein the surface resistance is reduced by using high polymer electrolytes as described in British Pat. No. 1,293,189. However, they produce various side effects, for example, they deteriorate the adhesion resistance or have a bad influence upon the photographic properties. Accordingly, it is impossible to incorporate them in such an amount that a sufficient antistatic property is obtained.

Further, as a process for preventing electrification which has low dependence on the materials, that of using fluorine containing cationic surface active agents having no polyoxyalkylene moiety has been described in U.S. Pat. No. 3,850,642 and Japanese Patent Applications (OPI) 52223/73, 127974/77 and 200235/83. However, in this technique, since the electricity generation is reduced by using a combination of the fluorine containing cationic surface active agent with another surface active agent showing positive electricity generation in the electrification series, not only is the production difficult because of being affected by the coating or drying conditions, but also the electricity generation property thereof easily changes during presevation after production. In addition, it is difficult to maintain the desirable property of preventing electrification.

Moreover, these fluorine containing cationic surface active agents having no polyoxyalkylene moiety have a serious fault that, since their solubility in water or the developing solution is lower than that of the fluorine containing cationic surface active agents having a polyoxyalkylene moiety, they easily form a complex which is slightly soluble in water with an anionic surface active agent ordinarily used as a coating agent or emulsifier or dispersing agent. This causes a repellent phenomenon in the case of coating or pollution in the development processing step.

SUMMARY OF THE INVENTION

A first object of the present invention is to provide antistatic photographic light-sensitive materials having low electricity generation property when employed with various materials.

A second object of the present invention is to provide photographic light-sensitive materials wherein the characteristic of preventing electrification does not change with the passage of time even after production.

A third object of the present invention is to provide photographic light-sensitive materials by which a uniform film can be obtained without causing defects such as "repelling" or "comet" in the case of coating at a high rate.

A fourth object of the present invention is to provide antistatic photographic light-sensitive materials which do not cause pollution when development processing is conducted.

A fifth object of the present invention is to provide photographic light-sensitive materials containing a fluorine containing surface active agent which does not have a bad influence upon the photographic properties.

These objects of the present invention have been met by silver halide photographic light-sensitive materials comprising a support and at least one silver halide emulsion layer, wherein at least one of said emulsion layers or another layer which constitutes said material contains a surface active agent represented by the following general formula:

$$Rf-\overset{\overset{R_1}{|}}{A}\leftarrow B\rightarrow_n D$$

wherein Rf represents a saturated or unsaturated hydrocarbon group having 3 to 24 carbon atoms wherein all or a part of hydrogen atoms is substituted by a fluorine atom, $R_1$ represents a substituted or unsubstituted saturated or unsaturated hydrocarbon group having 4 to 24 carbon atoms, A represents a trivalent bonding group, B represents a divalent group having an ether bond, D represents a hydrophilic group, and n represents an integer of 2 to 100.

DETAILED DESCRIPTION OF THE INVENTION

Preferred examples of the group represented by Rf in the general formula include $C_4F_9$, $C_6F_{13}$, $C_7F_{15}$, $C_8F_{17}$, $C_9F_{19}$, $C_{12}F_{25}$, $C_6F_{11}$, $C_9F_{17}$, $H\leftarrow CF_2\rightarrow_8$, etc.

Preferred examples of the trivalent bonding group represented by A include

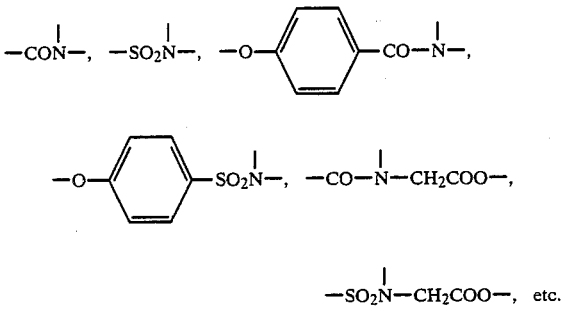

Preferred examples of $R_1$ include substituted or unsubstituted alkyl groups, alkenyl groups and aryl groups, which have 5 to 24 carbon atoms. Particularly preferred examples include a pentyl group, a hexyl group, an octyl group, a 2-ethylhexyl group, a decyl group, a dodecyl group, a myristyl group, a tridecyl group, a palmityl group, a stearyl group, an eicosyl group, a 5-hexenyl group, a 10-undecenyl group, an oleyl group, a phenyl group, a 1-naphthyl group, a t-butylphenyl group, a dodecylphenyl group, a p-octylphenyl group, etc.

The divalent group having an ether bond represented by B may have two or more repeating groups. Preferred examples thereof are substituted or unsubstituted oxyalkylene groups and oxyarylene groups (for example, an oxyphenylene group). Particularly preferred examples include an oxyethylene group, an oxypropylene group, a 2-hydroxy-oxypropylene group, a 2-methoxy-oxypropylene group, a 2-acetyloxy-oxypropylene group, an oxybutylene group, an α-phenyloxyethylene group, etc.

n preferably represents an integer of 3 to 50, more preferably 3 to 30.

Preferred examples of the hydrophilic group of D include groups containing an anion group such as —COOM, —$SO_3M$, —$OSO_3M$, or

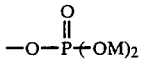

(wherein M represents a hydrogen atom, an alkali metal, an alkaline earth metal, an ammonium or a lower alkyl ammonium), a cation group such as

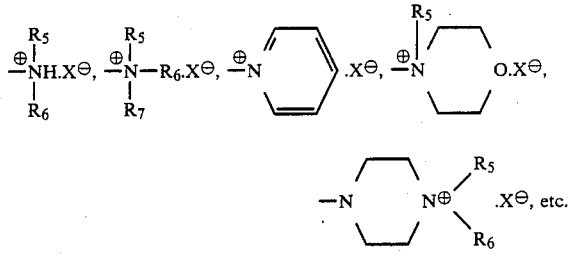

etc. (wherein $R_5$, $R_6$ and $R_7$ each is preferred to be an alkyl group having 1 to 12 carbon atoms, an alkenyl group or a phenyl group, and examples of X include OH, Cl, Br, I, $NO_3$, $CH_3COO$,

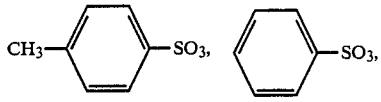

$CH_3SO_3$, $(SO_4)_{\frac{1}{2}}$, polybasic carboxylic acid radicals, etc.), an amphoteric group such as

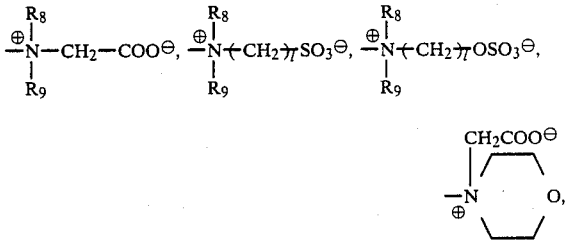

etc. (wherein $R_8$ and $R_9$ each represents a hydrogen atom, an alkyl group having 1 to 12 carbon atoms, an alkenyl group, or a phenyl group, and l represents 1 to 6), or a nonion group such as a hydrogen atom, a substituted or unsubstituted alkyl group having 1 to 24 carbon atoms, an alkenyl group, an aryl group or an acyl group (more preferably a hydrogen atom, a methyl group, an ethyl group, a butyl group, a methoxyethyl group, an allyl group, a phenyl group, an acetyl group or a glycidyl group).

In the following, typical examples in the present invention are described.

Examples of the surface active agents of the present invention:

1. $C_6F_{13}SO_2-N(C_5H_{11})-(CH_2CH_2O)_n-CH_2COOH$ n ≈ 3.0

2. $C_6F_{13}SO_2-N(C_{10}H_{21})-(CH_2CH_2O)_n-(CH_2)_3SO_3K$ n ≈ 4.0

3. $C_8F_{17}SO_2-N(C_6H_{13})-(CH_2CH_2O)_n-(CH_2)_4SO_3Na$ n ≈ 3.5

4. $C_8F_{17}SO_2-N(C_{10}H_{21})-(CH_2CH_2O)_n-COCH_2CH_2COONa$ n ≈ 4.7

5. $C_8F_{17}SO_2N(C_{12}H_{25})-(CH_2CH_2O)_n-(CH_2)_4SO_3Na$ n ≈ 4.6

6. $C_8F_{17}SO_2-N(C_{18}H_{35})-(CH_2CH_2O)_n-(CH_2)_4SO_3Na$ n = 6.5

-continued

7.

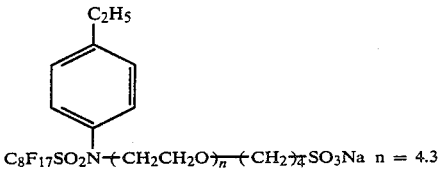

$C_8F_{17}SO_2N(CH_2CH_2O)_n(CH_2)_4SO_3Na$ n = 4.3

8.

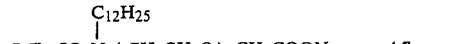

$C_8F_{17}SO_2N(C_{12}H_{25})(CH_2CH_2O)_nCH_2COONa$ n = 4.7

9.

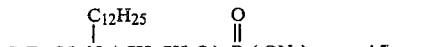

$C_8F_{17}SO_2N(C_{12}H_{25})(CH_2CH_2O)_nP(=O)(ONa)_2$ n = 4.7

10.

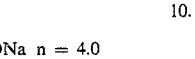

$C_{12}F_{25}CON(C_{12}H_{25})(CH_2CH_2O)_nCOCH{=}CH{-}COONa$ n = 4.0

11.

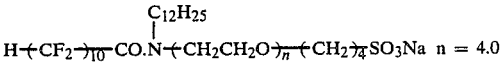

$H(CF_2)_{10}CO.N(C_{12}H_{25})(CH_2CH_2O)_n(CH_2)_4SO_3Na$ n = 4.0

12.

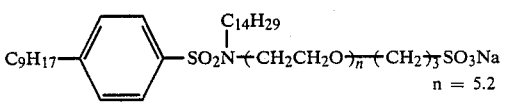

$C_9H_{17}{-}C_6H_4{-}SO_2N(C_{14}H_{29})(CH_2CH_2O)_n(CH_2)_3SO_3Na$ n = 5.2

13.

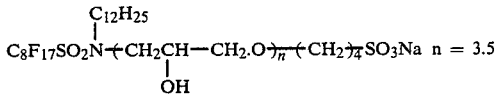

$C_8F_{17}SO_2N(C_{12}H_{25})(CH_2CH(OH){-}CH_2.O)_n(CH_2)_4SO_3Na$ n = 3.5

14.

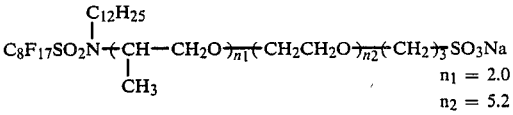

$C_8F_{17}SO_2N(C_{12}H_{25})(CH(CH_3){-}CH_2O)_{n1}(CH_2CH_2O)_{n2}(CH_2)_3SO_3Na$ $n_1$ = 2.0

$n_2$ = 5.2

15.

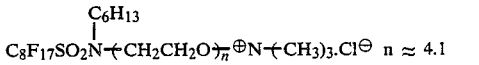

$C_8F_{17}SO_2N(C_6H_{13})(CH_2CH_2O)_n\oplus N(CH_3)_3.Cl^{\ominus}$ n ≈ 4.1

16.

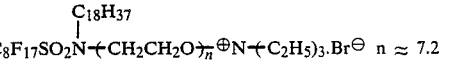

$C_8F_{17}SO_2N(C_{18}H_{37})(CH_2CH_2O)_n\oplus N(C_2H_5)_3.Br^{\ominus}$ n ≈ 7.2

17.

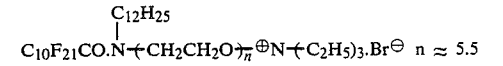

$C_{10}F_{21}CO.N(C_{12}H_{25})(CH_2CH_2O)_n\oplus N(C_2H_5)_3.Br^{\ominus}$ n ≈ 5.5

18.

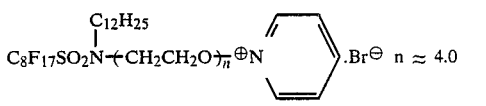

$C_8F_{17}SO_2N(C_{12}H_{25})(CH_2CH_2O)_n\oplus N{<}C_6H_4{>}.Br^{\ominus}$ n ≈ 4.0

19.

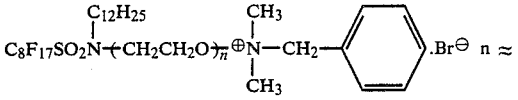

$C_8F_{17}SO_2N(C_{12}H_{25})(CH_2CH_2O)_n\oplus N(CH_3)_2{-}CH_2{-}C_6H_4.Br^{\ominus}$ n ≈ 4.0

20.

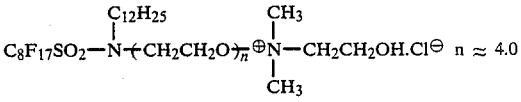

$C_8F_{17}SO_2{-}N(C_{12}H_{25})(CH_2CH_2O)_n\oplus N(CH_3)_2{-}CH_2CH_2OH.Cl^{\ominus}$ n ≈ 4.0

21.

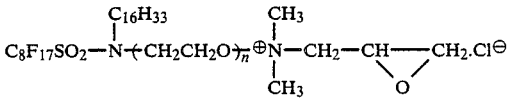

$C_8F_{17}SO_2{-}N(C_{16}H_{33})(CH_2CH_2O)_n\oplus N(CH_3)_2{-}CH_2{-}CH(O){-}CH_2.Cl^{\ominus}$ n ≈ 4.6

22.

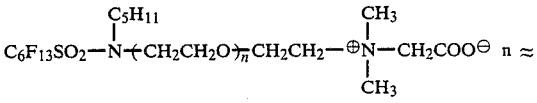

$C_6F_{13}SO_2{-}N(C_5H_{11})(CH_2CH_2O)_nCH_2CH_2{-}\oplus N(CH_3)_2{-}CH_2COO^{\ominus}$ n ≈ 3.0

23.

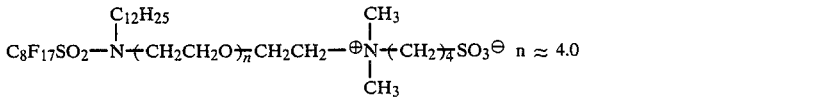

$C_8F_{17}SO_2{-}N(C_{12}H_{25})(CH_2CH_2O)_nCH_2CH_2{-}\oplus N(CH_3)_2{-}(CH_2)_4SO_3^{\ominus}$ n ≈ 4.0

24.

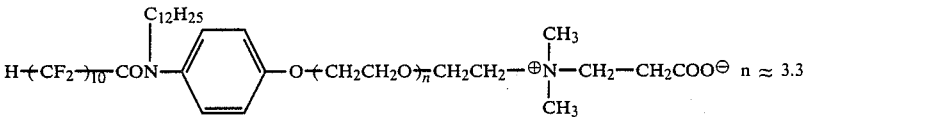

$H(CF_2)_{10}CON(C_{12}H_{25}){-}C_6H_4{-}O(CH_2CH_2O)_nCH_2CH_2{-}\oplus N(CH_3)_2{-}CH_2{-}CH_2COO^{\ominus}$ n ≈ 3.3

25.

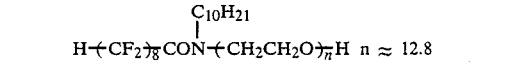

$H(CF_2)_8CON(C_{10}H_{21})(CH_2CH_2O)_nH$ n ≈ 12.8

26.

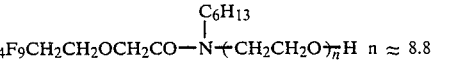

$C_4F_9CH_2CH_2OCH_2CO{-}N(C_6H_{13})(CH_2CH_2O)_nH$ n ≈ 8.8

27.

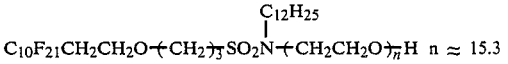

$C_{10}F_{21}CH_2CH_2O(CH_2)_3SO_2N(C_{12}H_{25})(CH_2CH_2O)_nH$ n ≈ 15.3

28.

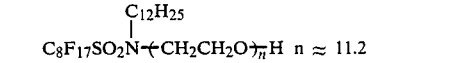

$C_8F_{17}SO_2N(C_{12}H_{25})(CH_2CH_2O)_nH$ n ≈ 11.2

29.

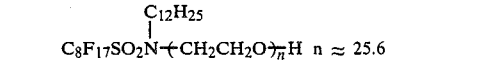

$C_8F_{17}SO_2N(C_{12}H_{25})(CH_2CH_2O)_nH$ n ≈ 25.6

30.

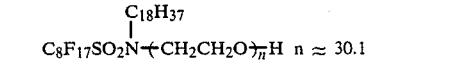

$C_8F_{17}SO_2N(C_{18}H_{37})(CH_2CH_2O)_nH$ n ≈ 30.1

31.

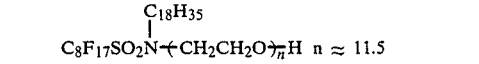

$C_8F_{17}SO_2N(C_{18}H_{35})(CH_2CH_2O)_nH$ n ≈ 11.5

32.

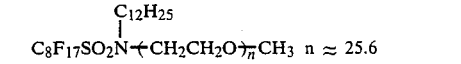

$C_8F_{17}SO_2N(C_{12}H_{25})(CH_2CH_2O)_nCH_3$ n ≈ 25.6

33.

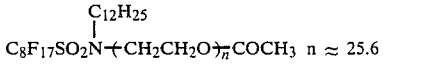

$C_8F_{17}SO_2N(C_{12}H_{25})(CH_2CH_2O)_nCOCH_3$ n ≈ 25.6

34.

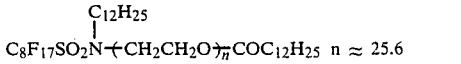

$C_8F_{17}SO_2N(C_{12}H_{25})(CH_2CH_2O)_nCOC_{12}H_{25}$ n ≈ 25.6

-continued

35.

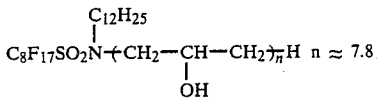

36.

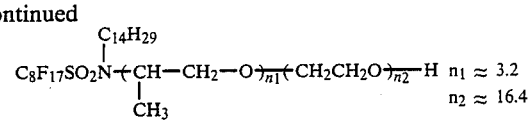

37.

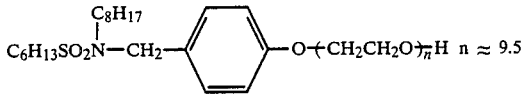

38.

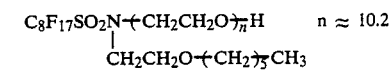

In the following, specific examples of the process for synthesis used in the present invention are illustrated. Unless otherwise indicated, all parts, percents, ratios and the like are by weight.

SYNTHESIS EXAMPLE 1

Synthesis of Compound 28

In a 30 ml three neck flask equipped with a stirrer, a dropping funnel and a reflux condenser, 37.1 g (0.2 mol) of n-dodecylamine, 22.3 g (0.22 mol) of triethylamine and 60 ml of acetonitrile were placed, and 110.5 g (0.22 mol) of perfluorooctanesulfonyl fluoride was dropwise added to the mixture with stirring at room temperature. The internal temperature increased by generation of heat, but dropwise addition was continued at a temperature not exceeding 60° C. After conclusion of the addition, the mixture was stirred at 60° C. for 30 minutes and additionally at 70° C. for 3 hours to carry out the reaction. After the mixture was cooled to room temperature, 200 ml of water was added thereto and stirred to form crystals. They were filtered off and washed with water. They were further washed with 400 ml of a mixture of 200 ml of 1N hydrochloric acid and 200 ml of ethanol, and additionally washed with water.

They were recrystallized from 800 ml of acetonitrile to obtain 82 g (yield: 62%) of white crystals of N-dodecylperfluorooctanesulfonamide. The melting point was 91°–92° C.

In a 100 ml three neck flask equipped with a stirrer, 30.0 g (0.045 mol) of N-dodecylperfluorooctanesulfonamide and 0.45 g of caustic soda were placed and heated to 90°–95° C. After the mixture was melted, an ethylene oxide gas was blown through the mixture.

When the weight of the reaction contents increased to 22 g, blowing of the ethylene oxide gas was stopped. After cooling, the contents were poured in a beaker. After 120 ml of a saturated saline solution was added with stirring, 240 ml of ethyl acetate was added thereto to dissolve. The aqueous phase was separated by a separatory funnel, and the ethyl acetate phase was similarly washed twice with a saturated saline solution. The ethyl acetate phase was dried with anhydrous sodium sulfate. After filtration, ethyl acetate was distilled away to obtain 51 g (yield: 98%) of light brown Compound 28. The mol number of added ethylene oxide: n was 11.2 (measured from H-NMR).

SYNTHESIS EXAMPLE 2

Synthesis of Compound 5

In a 100 ml three neck flask equipped with a stirrer and a reflux condenser, 14.8 g (0.017 mol) of an ethylene oxide adduct of N-dodecylperfluorooctanesulfonamide: n=4.6 obtained by the same manner as in Synthesis Example 1 and 4.4 ml of toluene were placed, and 0.88 g of caustic soda and then 3.0 g (0.22 mol) of butanesultone were added with stirring thereto. The mixture was heated to 70°–75° C. for 3 hours with stirring. After cooling to 50° C., 75 ml of ethanol was added thereto. Since the temperature of the mixture was dropped by the addition of ethanol, the mixture was again heated to 50° C. to dissolve, then, the mixture was cooled to room temperature.

After insoluble inorganic salts were filtered out, 150 ml of acetonitrile was added, and the mixture was heated to 50° C. The mixture was then slowly cooled to room temperature, by which a pasty compound precipitated. The solvent was removed by decantation, and the precipitate was washed with 75 ml of acetonitrile, and dried in vacuum at 60° C. for 14 hours to obtain 13.6 g of Compound 5 (yield: 78%).

The surface active agent of the present invention is added to at least one layer of silver halide emulsion layers or other constituent layers in the photographic light-sensitive material. Examples of other constituent layers include a surface protective layer, a back layer, an intermediate layer, an undercoat layer, etc.

The surface active agent of the present invention is preferably added to the surface protective layer, the back layer, the intermediate layer or the undercoat layer. In the case that the back layer consists of two layers, it may be contained in any of these layers. Further, it can be added to an overcoat layer provided on the surface protective layer. The surface active agent of the present invention exhibits superior effects when it is added to the surface protective layer, the back layer or the overcoat layer.

In order to apply the surface active agent of the present invention to the photographic light-sensitive material, the surface active agent is dissolved in water, an organic solvent such as methanol, isopropanol, acetone, etc., or a mixed solvent thereof, and the resulting solution is added to a coating solution for the surface protective layer, the back layer, etc. The coating solution is then applied by dip coating, air knife coating, spraying or extrusion coating using a hopper as described in U.S. Pat. No. 2,681,294, or two or more layers are coated simultaneously by methods described in U.S. Pat. Nos. 3,508,947, 2,941,898, 3,526,528, etc. The surface active agent of the present invention may be incorporated into the photographic light-sensitive material by adding the solvent solution of the surface active agent to an antistatic solution in which the photographic light-sensitive material is dipped. If necessary, an antistatic solution containing the surface active agent of the present invention (containing only solvent or containing a binder) is applied additionally to the protective layer.

The surface active agent of the present invention is preferred to be used in an amount of from 0.0001 to 2.0 g, particularly from 0.0005 to 0.05 g, per square meter of the photographic light-sensitive material.

The above described range, of course, varies depending upon the kind of the photographic film base, photographic composition, configuration or coating process.

Two or more of the surface active agents of the present invention may be used as a mixture.

The layer containing the surface active agent of the present invention or another layer may contain another antistatic agent together, by which a further preferred antistatic effect can be obtained. The preferred amount added of such an antistatic agent is in the range of from 0.0005 to 5 g/m$^2$, particularly from 0.001 to 1.5 g/m$^2$, of the photographic light-sensitive material. Examples of such an antistatic agent include polymers as described in U.S. Pat. Nos. 2,882,157, 2,972,535, 3,062,785, 3,262,807, 3,514,291, 3,615,531, 3,753,716, 3,938,999, 4,070,189 and 4,147,550, German Pat. No. 2,800,466, and Japanese Patent Applications (OPI) Nos. 91165/73, 94433/73, 46733/74, 54672/75, 94053/75 and 129520/77, surface active agents as described in U.S. Pat. Nos. 2,982,651, 3,428,456, 3,457,076, 3,454,625, 3,552,972, 3,655,387, etc. Metal oxides and colloidal silica as described in U.S. Pat. Nos. 3,062,700, 3,245,833, 3,525,621, etc., and the so-called matting agents such as barium strontium sulfate, polymethyl methacrylate, methyl methacrylate-methacrylic acid copolymer, colloidal silica, powdery silica, etc., may be used as an antistatic agent in the present invention.

Further, polyol compounds as described in Japanese Patent Application (OPI) No. 89626/79, such as ethylene glycol, propylene glycol, 1,1,1-trimethylolpropane, etc., can be added to the layer containing the surface active agent of the present invention or another layer, by which a further preferred antistatic effect can be obtained. The amount added of such polyol compounds are preferably in an amount of from 0.001 to 1 g/m$^2$ of the photographic light-sensitive material.

The support used for the photographic light-sensitive material of the present invention includes, for example, films of polyolefins such as polyethylene, polystyrene, cellulose derivatives such as cellulose triacetate, polyesters such as polyethylene terephthalate, etc., sheets prepared by coating both sides of synthetic paper or paper with the above described polymer films, and analogous thereof.

The support used in the present invention may be provided with an antihalation layer. For such a purpose, carbon black and various dyes, for example, oxonol dyes, azo dyes, arylidene dyes, styryl dyes, anthraquinone dyes, merocyanine dyes and tri-(or di-) arylmethane dyes, are used. The matting agents above are preferred to be used in an amount of from 0.001 to 5 g/m$^2$, particularly 0.005 to 2 g/m$^2$.

The light-sensitive materials according to the present invention include conventional black-and-white silver halide light-sensitive materials (e.g., black-and-white light-sensitive materials for photographing, X-ray black-and-white sensitive materials, black-and-white light-sensitive materials for printing, etc.), conventional multilayer color light-sensitive materials (e.g., color reversal films, color negative films, color positive films, etc.), and other various light-sensitive materials. The present invention is particularly effective for silver halide light-sensitive materials for high temperature rapid processing and high speed silver halide light-sensitive materials.

In the following, silver halide light-sensitive materials according to the present invention are briefly described.

As binders, it is possible to use proteins such as gelatin, casein, etc.; cellulose compounds such as carboxymethyl cellulose, hydroxyethyl cellulose, etc.; sugar derivatives such as agar, sodium alginate, starch derivatives, etc.; synthetic hydrophilic colloids, e.g., polyvinyl alcohol, poly-N-vinylpyrrolidone, acrylic acid copolymer, polyacrylamide, and derivatives and partially hydrolyzed products thereof.

The term "gelatin" used herein means the so-called lime-processed gelatin, acid-processed gelatin and enzyme-processed gelatin.

The kind of silver halide, the process for producing silver halide, the chemical sensitization process, the antifoggants, the stabilizers, the hardeners, the antistatic agents, the plasticizers, the lubricants, the coating aids, the matting agents, the whitening agents, the spectral sensitizing dyes, the dyes, the color couplers, etc., utilized in the silver halide emulsion layers and the surface protective layer, etc., of the photographic light-sensitive materials of the present invention are not particularly restricted and those described in, for example, *Product Licensing,* Vol. 92, pages 107–110 (December, 1971) and *Research Disclosure,* Vol. 176, pages 22–31 (December, 1978) can be used in the present invention.

For example, it is possible to refer to the latter reference, Chapter I on page 22 with respect to the preparation of emulsions, Chapter III on page 23 with respect to the chemical sensitization process, Chapter IV on page 23 with respect to the spectral sensitizing agents, Chapter V on page 24 with respect to the whitening agents, Chapter VI with respect to the antifoggants and stabilizers, Chapter VII on page 25 with respect to the color couplers, Chapter IX and Chapter X on page 26 with respect to the vehicles and hardeners, Chapter XI on page 26 with respect to the coating aids, Chapter XII on page 27 with respect to the plasticizers and lubricants, and Chapter XVI with respect to the matting agents.

Further, it is possible to refer to the same reference, Chapters XV to XX with respect to the process for preparing the photographic light-sensitive materials of the present invention and the development processing.

In the following, the present invention will be illustrated with reference to examples, but it should be understood that these examples are not intended to limit the present invention.

EXAMPLE 1

Samples 1-1 to 1-14 comprising an emulsion layer and a protective layer provided in turn on one side of a polyethylene terephthalate film support having a thickness of about 175 μm were prepared by coating and drying according to the conventional method. The compositions were as follows.

Emulsion Layer: About 5 μm
- Binder: Gelatin 2.5 g/m$^2$
- Coated silver amount: 5 g/m$^2$
- Silver halide: AgI 1.5 mol% and AgBr 98.5 mol%
- Antifoggant: 1-Phenyl-5-mercaptotetrazole 0.5 g/Ag 100 g Protective Layer: About 1 μm
- Binder: Gelatin 1.7 g/m$^2$
- Coating aid: Sodium salt of N-oleoyl-N-methyltaurine 7 mg/m$^2$
- Hardener: Sodium salt of 2,4-dichloro-6-hydroxy-1,3,5-triazine 0.4 g/100 g gelatin Sample 1-1 was composed of only the above described compositions, and Samples 1-2 to 1-7 were composed of the above described compositions wherein the protective layer contained Compound 6, 8 or 13 of the present invention in an amount of 5 to 10 mg/m$^2$, respectively.

For comparison, samples composed of the above described compositions wherein the protective layer contained Comparative Compounds (a) to (c) were prepared.

Comparative Compound (a):

$C_8F_{17}SO_3K$

Comparative Compound (b):

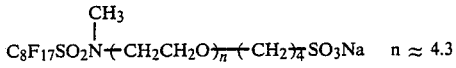

Comparative Compound (c):

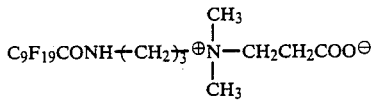

After these unexposed samples were conditioned at 25° C. and 25% RH for 2 hours, they were rubbed by a rubber roller or a nylon roller in order to examine the state of static marks. Thereafter, they were developed with the following developing solution, fixed and washed with water to examine degree of static marks.

Composition of the Developing Solution:

| | |
|---|---|
| Hot Water | 800 ml |
| Sodium Tetrapolyphosphate | 2.0 g |
| Anhydrous Sodium Sulfite | 50 g |
| Hydroquinone | 10 g |
| Sodium Carbonate (1 hydrate) | 40 g |
| 1-Phenyl-3-pyrazolidone | 0.3 g |
| Potassium Bromide | 2.0 g |
| Water to make | 1,000 ml (pH 10.2) |

The results of the antistatic effect of these samples are shown in Table 1.

TABLE 1

| Sample No. | Surface Active Agent | Amount Added ($mg/m^2$) | Degree of Static Marks Rubber | Nylon |
|---|---|---|---|---|
| 1-1 | Nothing | — | D | D |
| 1-2 | Compound 6 | 5 | A | B |
| 1-3 | Compound 6 | 10 | A | A |
| 1-4 | Compound 8 | 5 | A | A |
| 1-5 | Compound 8 | 10 | B | A |
| 1-6 | Compound 13 | 5 | A | A |
| 1-7 | Compound 13 | 10 | A | B |
| 1-8 | Comparative Compound (a) | 5 | C | B |
| 1-9 | Comparative Compound (a) | 10 | A | C |
| 1-10 | Comparative Compound (a) | 20 | D | B |
| 1-11 | Comparative Compound (b) | 5 | A | C |
| 1-12 | Comparative Compound (b) | 10 | C | B |
| 1-13 | Comparative Compound (c) | 5 | C | B |
| 1-14 | Comparative Compound (c) | 10 | C | C |

In the above table, the evaluation of the degree of static marks was carried out on the basis of the following four stages:

A: Generation of static marks was not observed at all.

B: Generation of static marks was slightly observed.

C: Generation of static marks was considerably observed.

D: Generation of static marks was observed on nearly the entire surface.

As can be understood from Table 1, Samples 1-2 to 1-7 using the surface active agents of the present invention show an excellent antistatic effect in that generation of static marks caused by two different rollers composed of different materials (rubber, nylon) is hardly observed. On the contrary, the antistatic property in the control is very inferior, and, in Comparative Samples 1-8 to 1-14, it is impossible to improve the antistatic property when using both materials. For example, when generation of static marks caused by a rubber roller is improved, that caused by the nylon roller becomes inferior, and, inversely, when generation of static marks caused by the nylon roller is improved, that caused by the rubber roller becomes great. Thus, it is understood that the antistatic property of the surface active agents of the present invention is particularly superior.

EXAMPLE 2

Samples 2-1 to 2-8 composed of a triacetyl cellulose support, an antihalation layer, a red-sensitive layer, an intermediate layer, a green-sensitive layer, a yellow filter layer, a blue-sensitive layer and a protective layer, which were provided in the above described order, were prepared by coating and drying according to the conventional method. The composition of each layer is as follows.

Antihalation Layer

Binder: Gelatin 4.4 $g/m^2$

Hardener: 1,3-Bis(vinylsulfonyl)propanol-2 1.2 g/100 g binder

Coating aid: Sodium dodecylbenzenesulfonate 4 $mg/m^2$

Antihalation component: Black colloidal silver 0.4 $g/m^2$

Red-Sensitive Layer

Binder: Gelatin 7 $g/m^2$

Hardener: 1,3-Bis(vinylsulfonyl)propanol-2 1.2 g/100 g binder

Coating aid: Sodium dodecylbenzenesulfonate 10 $mg/m^2$

Coated silver amount: 3.1 $g/m^2$

Silver halide composition: AgI 2 mol% and AgBr 98 mol%

Antifoggant: 4-Hydroxy-6-methyl-1,3,3a,7-tetraazaindene 0.98 g/Ag 100 g

Color former: 1-Hydroxy-4-(2-acetylphenyl)azo-N-[4-(2,4-di-tert-amylphenoxy)butyl]-2-naphthamide 38 g/Ag 100 g Sensitizing dye: Anhydro-5,5'-dichloro-9-ethyl-3,3'-di(3-sulfopropyl)thiacarbocyanine hydroxide.-pyridinium salt 0.3 g/Ag 100 g Intermediate Layer Binder: Gelatin 2.6 $g/m^2$ Hardener: 1,3-Bis(vinylsulfonyl)propanol-2 1.2 g/100 g binder Coating aid: Sodium dodecylbenzenesulfonate 12 $mg/m^2$ Green-Sensitive Layer Binder: Gelatin 6.4 $g/m^2$ Hardener: 1,3-Bis(vinylsulfonyl)propanol-2 1.2 g/100 g binder Coating aid: Sodium dodecylbenzenesulfonate 9 $mg/m^2$ Coated silver amount: 2.2 $g/m^2$ Silver halide composition: AgI 3.3 mol% and AgBr 96.7 mol%

Stabilizer: 4-Hydroxy-6-methyl-1,3,3a,7-tetraazaindene 0.6 g/Ag 100 g

Color former: 1-(2,4,6-Trichlorophenyl)-3-[3-(2,4-di-tert-amylphenoxy)acetamido]benzamido-4-(4-methoxyphenyl)azo-5-pyrazolone 3.7 g/Ag 100 g Sensitizing dye: Anhydro-5,5'-diphenyl-9-ethyl-3,3'-di(2-sulfoethyl)oxacarbocyanine hydroxide.-pyridinium salt 0.3 g/Ag 100 g Yellow Filter Layer Binder: Gelatin 2.3 g/m$^2$ Filter component: Yellow colloidal silver 0.7 g/m$^2$ Hardener: 1,3-Bis(vinylsulfonyl)propanol-2 1.2 g/100 g binder Surface active agent: Sodium salt of 2-sufonatosuccinic acid bis(2-ethylhexyl)ester 7 mg/m$^2$ Blue-Sensitive Layer Binder: Gelatin 7 g/m$^2$ Hardener: 1,3-Bis(vinylsulfonyl)propanol-2 1.2 g/100 g binder Ciating aid: Sodium dodecylbenzenesulfonate 8 mg/m$^2$ Coated silver amount: 2.2 g/m$^2$ Silver halide composition: AgI 3.3 mol% and AgBr 96.7 mol%

Stabilizer: 4-Hydroxy-6-methyl-1,3,3a,7-tetraazaindene 0.4 g/Ag 100 g

Color former: 2'-Chloro-5'-[2-(2,4-di-tert-amylphenoxy)butyramido]-α-(5,5'-dimethyl-2,4-dioxo-3-oxazolidinyl)-α-(4-metoxybenzoyl)acetanilide 45 g/Ag 100 g Protective Layer Binder: Gelatin 2 g/m$^2$ Hardener: 1,3-Bis(vinylsulfonyl)propanol-2 1.2 g/100 g binder Coating aid: Sodium dioctylsulfosuccinate 15 mg/m$^2$ Matting agent: Copolymer of polymethyl methacrylate and polymethacrylate (copolymerization ratio: 6:4 (by mol), average grain size: 2.5 μm) 100 mg/m$^2$ Sample 2-1 was composed of only the above described composition, and Samples 2-2 to 2-8 were composed of the above described compositions wherein Compounds 5, 19, 23 and 28 of the present invention or Comparative Compounds (a) to (c) were added to the protective layer in an amount of 6 mg/m$^2$, respectively. The antistatic properties of these samples were examined by the same manner as in Example 1, except that they were subjected to conventional color development processing (e.g., the processing described in the examples of European Pat. No. 115,304). The results obtained are shown in Table 2.

TABLE 2

| Sample No. | Surface Active Agent | Amount Added (mg/m$^2$) | Degree of Static Marks just after Coating | | Degree of Static Marks after Passage of 1 Week at 40° C., 70% RH | |
|---|---|---|---|---|---|---|
| | | | Rubber | Nylon | Rubber | Nylon |
| 2-1 | Nothing (control) | — | D | D | D | D |
| 2-2 | Compound 5 | 6 | A | B | A | B |
| 2-3 | Compound 19 | 6 | A | A | A | B |
| 2-4 | Compound 23 | 6 | B | A | A | A |
| 2-5 | Compound 28 | 6 | A | A | B | A |
| 2-6 | Comparative Compound (a) | 6 | A | C | B | D |
| 2-7 | Comparative Compound (b) | 6 | B | C | A | D |
| 2-8 | Comparative Compound (c) | 6 | C | A | D | B |

TABLE 2-continued

As shown in Table 2, film samples using the surface active agents of the present invention show an excellent antistatic performance in that not only generation of static marks caused by two different materials (rubber and nylon) was hardly observed, but also the antistatic property thereof does not change even under the condition of compulsory preservation. On the contrary, the prior known fluorine containing surface active agents (Comparative Compounds (a) to (c) have a fault in that not only generation of static marks caused by both materials of rubber and nylon cannot be improved at the same time before compulsory preservation but also the performance thereof greatly changes after compulsory preservation. Accordingly, it is obvious that the surface active agents of the present invention are superior. When the samples of the present invention were exposed to light according to the JIS process and subjected to conventional color development processing (e.g., the processing described in the examples of European Pat. No. 115,304), a bad influence upon photographic properties was not observed at all. Thus, it was confirmed that the surface active agents of the present invention did not have a bad influence upon the photographic properties.

EXAMPLE 3

Samples 3-1 to 3-9 wherein a back layer and a protective layer for the back layer were provided on one side of a triacetyl cellulose support and an antihalation layer, a red-sensitive layer, an intermediate layer, a green-sensitive layer, a yellow filter layer, a blue-sensitive layer and a protective layer were provided in this order on the other side of the support were prepared by coating and drying according to the conventional method. The composition of each layer is shown in the following.

Back Layer

Binder: Lime-processed gelatin 6.2 g/m$^2$

Salt: Potassium nitrate 0.1 g/m$^2$

Hardener: 1,3-Bis(vinylsulfonyl)propanol-2 0.6 g/100 g binder

Back Protective Layer

Binder: Lime-processed gelatin 2.2 g/m$^2$

Matting agent: Polymethyl methacrylate (average grain size: 2.5 μm) 20 mg/m$^2$

Hardener: 1,3-Bis(vinylsulfonyl)propanol-2 1.2 g/100 g binder

Coating aid:

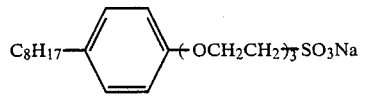

100 mg/m$^2$

The antihalation layer and the other layers were the same as those in Example 2, and the protective layer was the same as that of Sample 2-6.

Sample 3-1 was composed of only the above described composition, and Samples 3-2 to 3-5 were composed of the compositions of Sample 3-1 wherein Compounds 18, 20, 22 and 30 of the present invention were added to the protective layer for the back layer in an amount of 1.5 mg/m$^2$. Further, Samples 3-6 to 3-9 were prepared as comparative samples by incorporating Comparative Compounds (a), (b) and (c) in Example 1 and Comparative Compound (d) in the protective layer for the back layer of the composition of Sample 3-1.

Comparative Compound (d):

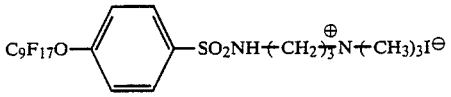

The antistatic property of them were examined by the same manner as in Example 1, except that the back face was rubbed by a rubber or Delrin roller. The results obtained are shown in the following.

TABLE 3

| Sample No. | Surface Active Agent | Amount Added (mg/m$^2$) | Degree of Static Marks just after Coating: Rubber | Degree of Static Marks just after Coating: Delrin | Degree of Static Marks after Passage of 1 Week at 40° C., 70% RH: Rubber | Degree of Static Marks after Passage of 1 Week at 40° C., 70% RH: Delrin |
|---|---|---|---|---|---|---|
| 3-1 | Nothing (control) | — | D | D | D | D |
| 3-2 | Compound 18 | 3 | A | B | A | A |
| 3-3 | Compound 20 | 3 | A | A | B | A |
| 3-4 | Compound 22 | 3 | B | A | A | A |
| 3-5 | Compound 30 | 3 | A | B | A | B |
| 3-6 | Comparative Compound (a) | 3 | B | B | B | C |
| 3-7 | Comparative Compound (b) | 3 | A | B | D | A |
| 3-8 | Comparative Compound (c) | 3 | B | C | B | D |
| 3-9 | Comparative Compound (d) | 3 | A | B | B | D |

As is obvious from Table 3, in Samples 3-2 to 3-5 using the surface active agents of the present invention in the back protective layer, generation of static marks hardly changes depending upon the material (rubber, Delrin) even just after coating or after compulsory preservation. On the contrary, in Samples 3-6 to 3-9 using the prior known fluorine containing surface active agents (Comparative Compounds (a) to (d) including a cationic agent) in the back protective layer, the degree of static marks caused by rubber and Delrin cannot be improved at the same time, and the generation of static marks greatly changes by the passage of time. Thus, it is obvious that the antistatic performance of surface active agents of the present invention is superior.

EXAMPLE 4

Samples wherein a triacetyl cellulose support, an antihalation layer, a red-sensitive layer, an intermediate layer, a green-sensitive layer, a yellow filter layer and a blue-sensitive layer were superimposed similarly to Example 2 and a protective lower layer and a protective upper layer having the following compositions were superimposed thereon in this order were prepared by coating and drying according to the conventional method.

Protective Lower Layer

Binder: Gelatin 1.6 g/m$^2$

Hardener: 1,3-Bis(vinylsulfonyl)propanol-2 1.2 g/100 g binder

Coating aid: Sodium dioctylsulfosuccinate 5 mg/m$^2$

Ultraviolet absorbent:

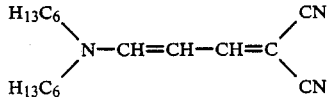

300 mg/m$^2$

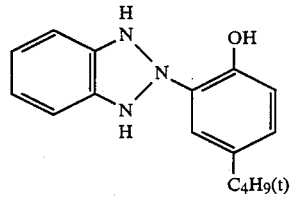

100 mg/m$^2$

Protective Upper Layer

Binder: Oleic acid-processed gelatin (dielectric point: 7) 1 g/m$^2$

Hardener: 1,3-Bis(vinylsulfonyl)propanol-2 1.2 g/100 g binder

Matting agent: Copolymer of polymethyl methacrylate and polymethacrylate (copolymerization ratio: 5:5 (by mol), average grain size: 3 μm) 30 mg/m$^2$, polymethyl methacrylate (average grain size: 3 μm) 10 mg/m$^2$ Sample 4-1 was composed of only the above described composition, and Samples 4-2, 4-3, 4-4 and 4-5 were composed of the above described composition wherein Compound 2 of the present invention, Comparative Compound (e) and a coating aid were added. The coating property and antistatic property of these samples were examined in the same manner as in Example 2. The results obtained are shown in Table 4.

Comparative Compound (e):

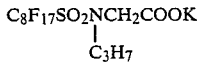

TABLE 4

| Sample No. | Coating Aid | | Surface Active Agent | | Coating Property Number of Repelling/m$^2$ | Degree of Static Marks: Rubber | Degree of Static Marks: Delrin | Degree of Static Marks: Nylon |
|---|---|---|---|---|---|---|---|---|
| 4-1 | Sodium dioctyl-sulfosuccinate | 80 mg/m$^2$ | Nothing | (control) | 0 | D | D | D |
| 4-2 | Sodium dioctyl-sulfosuccinate | 7 mg/m$^2$ | Compound 2 | 6 mg/m$^2$ | 0 | A | A | B |
| 4-3 | Sodium dioctyl-sulfosuccinate | 30 mg/m$^2$ | Compound 2 | 9 mg/m$^2$ | 0 | A | A | A |
| 4-4 | Sodium dioctyl- | 80 mg/m$^2$ | Compound 2 | 40 mg/m$^2$ | 0 | B | A | A |

TABLE 4-continued

| Sample No. | Coating Aid | | Surface Active Agent | | Coating Property Number of Repelling/m² | Degree of Static Marks Rubber | Delrin | Nylon |
|---|---|---|---|---|---|---|---|---|
| | sulfosuccinate | | | | | | | |
| 4-5 | Sodium dioctyl-sulfosuccinate | 30 mg/m² | Comparative Compound (e) | 6 mg/m² | 4 | D | B | A |
| 4-6 | Sodium dioctyl-sulfosuccinate | 30 mg/m² | Comparative Compound (e) | 18 mg/m² | 13 | B | D | B |

As is obvious from Table 4, the surface active agent of the present invention has not only an excellent ability of preventing electrification with respect to different kinds of materials, because static marks are hardly generated by three rollers composed of three kinds of materials (rubber, nylon and Delrin), but also has an excellent coating property.

On the other hand, in the comparative samples an antistatic property satisfactory for all materials at the same time cannot be obtained even if the amount of the surface active agent is varied, and the coating property is inferior.

EXAMPLE 5

Onto a polyethylene terephthalate film support having a thickness of 180 μm which was subjected to undercoating, a silver halide emulsion layer having the following composition was coated and a protective layer having the following composition was coated on said layer, followed by drying to prepare black-and-white silver halide light-sensitive materials. To the protective layer, the surface active agent of the present invention or the comparative surface active agent was added.

Emulsion Layer: About 5 μm

| | |
|---|---|
| Gelatin | 2.5 g/m² |
| Silver iodobromide (silver iodide 1.5 mol %) | 5 g/m² |
| 1-Phenyl-5-mercaptotetrazole | 25 mg/m² |

Protective Layer: About 1 μm

| | |
|---|---|
| Gelatin | 1.7 g/m² |
| Sodium salt of 2,6-dichloro-6-hydroxy 1,3,5-triazine | 10 mg/m² |
| Coating Aid: | |
| Sodium dodecylbenzenesulfonate | 25 mg/m² |
| Surface active agent of the present invention or comparative surface active agent | 5 mg/m² |

The examination of static mark generation was carried out by a method which comprises placing an unexposed light-sensitive material on a rubber sheet so as to face the surface containing the antistatic agent downwards, pressing it with rubber roll, and separating it to cause static marks (25° C., 25% RH).

In order to evaluate the degree of static mark generation, each sample was developed at 20° C. for 5 minutes with a developing solution having the following composition. Evaluation was carried out according to the method described in Example 1.

Composition of Developing Solution

| | |
|---|---|
| N—Methyl-p-aminophenol sulfate | 4 g |

-continued

| | |
|---|---|
| Anhydrous sodium sulfite | 60 g |
| Hydroquinone | 10 g |
| Sodium carbonate (1 hydrate) | 53 g |
| Potassium bromide | 25 g |
| Water to make | 1,000 ml |

After the above described samples were exposed to light using a tungsten lamp through a Filter SP-14 produced by Fuji Photo Film Co., Ltd. they were developed with a developing solution having the following composition (35° C., 30 seconds) and subjected to fixation and washing with water. Then, the photographic characteristics of them were examined.

Composition of Developing Solution

| | |
|---|---|
| Hot water | 800 ml |
| Sodium tetrapolyphosphate | 2.0 g |
| Anhydrous sodium sulfite | 50 g |
| Hydroquinone | 10 g |
| Sodium carbonate (1 hydrate) | 40 g |
| 1-Phenyl-3-pyrazolidone | 0.3 g |
| Potassium bromide | 2.0 g |
| Water to make | 1,000 ml |

Samples were uniformly exposed to light so that the optical density after development became 1.0, and they were then subjected to deveopment processing by an automatic developing apparatus (consisting of three baths, a developing solution: RD-II produced by Fuji Photo Film Co., Ltd. at 35° C., a fixing solution: Fuji-F produced by Fuji Photo Film Co., Ltd. at 35° C., and a water wash bath). After development, the degree of striped unevenness of density caused on the samples was examined (referred to as processing trouble).

Evalaution of the processing trouble was carried out according to the following four stages.

A: Generation of unevenness of density was not observed.

B: Unevenness of density was slightly generated.

C: Unevenness of density was considerably generated.

D: Unevenness of density was remarkably generated.

The above described examinations were carried out with respect to Surface Active Agents 2, 15 and 30 of the present invention and the above described Comparative Compound (e) and the following Comparative Compounds (f) and (g). The results obtained are shown in Table 5.

Comparative Compound (f):

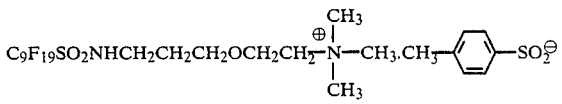

Comparative Compound (g):

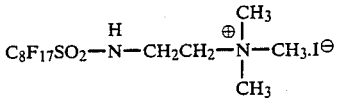

TABLE 5

| Sample No. | Surface Active Agent | Degree of Static Marks | Photographic Sensitivity | Processing Trouble |
|---|---|---|---|---|
| 5-1 | Nothing (control) | D | 100 | A |
| 5-2 | Compound 15 | B | 99 | A |
| 5-3 | Compound 18 | A | 98 | A |
| 5-4 | Compound 20 | A | 96 | A |
| 5-5 | Comparative Compound (e) | B | 97 | C |
| 5-6 | Comparative Compound (f) | B | 98 | D |
| 5-7 | Comparative Compound (g) | A | 95 | D |

As is shown in Table 5, the fluorine containing cationic surface active agents of the present invention have excellent performances in that static marks are hardly generated, photographic sensitivity is not reduced, and no processing trouble is caused. On the contrary, the comparative fluorine containing cationic surface active agents do not satisfy all of the requirements of the antistatic property, the photographic sensitivity and the processing trouble, and the processing trouble is particularly inferior.

As a result, the surface active agents of the present invention solve the problems which could not be solved using the prior fluorine containing surface active agents, and superiority of them is specially mentioned. Thus, it becomes possible to obtain excellent images having a good antistatic property.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support and at least one silver halide emulsion layer, wherein at least one of said emulsion layer or another layers which constitute said material contains a surface active agent represented by the following general formula:

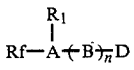

wherein Rf represents a saturated or unsaturated hydrocarbon group having 3 to 24 carbon atoms wherein all or a part of hydrogen atoms is substituted by a fluorine atom, $R_1$ represents a substituted or unsubstituted saturated or unsaturated hydrocarbon group having 5 to 24 carbon atoms, A represents a trivalent nitrogen bonding group, B represents a divalent hydrocarbon group having an ether bond, D represents a hydrophilic group, and n represents an integer of 2 to 100.

2. The silver halide photographic light-sensitive material as claimed in claim 1, wherein A is selected from the group consisting of

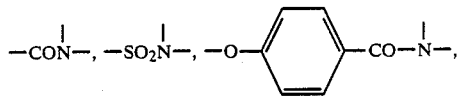

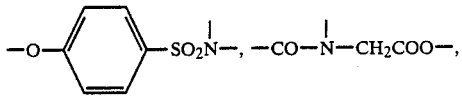

and $-\overset{|}{SO_2N}-CH_2COO-$.

3. The silver halide photographic light-sensitive material as claimed in claim 1, wherein Rf is selected from the group consisting of $C_4F_9$, $C_6F_{13}$, $C_7F_{15}$, $C_8F_{17}$, $C_9F_{19}$, $C_{12}F_{25}$, $C_6F_{11}$, $C_9F_{17}$, and $H(CF_2)_8$.

4. The silver halide photographic light-sensitive material as claimed in claim 1, wherein $R_1$ is selected from the group consisting of substituted or unsubstituted alkyl groups, alkenyl groups and aryl groups which have 5 to 24 carbon atoms.

5. The silver halide photographic light-sensitive material as claimed in claim 4, wherein $R_1$ is selected from the group consisting of a pentyl group, a hexyl group, an octyl group a 2-ethylhexyl group, a decyl group, a dodecyl group, a myristyl group, a tridecyl group, a palmityl group, a stearyl group, an eicosyl group, a 5-hexenyl group, a 10-undecenyl group, an oleyl group, a phenyl group, a 1-naphthyl group, a t-butylphenyl group, a dodecylphenyl group and a p-octylphenyl group.

6. The silver halide photographic light-sensitive material as claimed in claim 1, wherein B is selected from the group consisting of substituted or unsubstituted oxyalkylene groups and oxyarylene groups.

7. The silver halide photographic light-sensitive material as claimed in claim 6, wherein B is selected from the group consisting of an oxyethylene group, an oxypropylene group, a 2-hydroxy-oxypropylene group, a 2-methoxy-oxypropylene group, a 2-acetyloxyoxypropylene group, an oxybutylene group and an α-phenyloxyethylene group.

8. The silver halide photographic light-sensitive material as claimed in claim 1, wherein D is selected from the group consisting of —COOM, $-SO_3M$, $-OSO_3M$ and

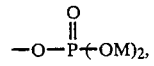

wherein M represents a hydrogen atom, an alkali metal, an alkaline earth metal, an ammonium or a lower alkyl ammonium.

9. The silver halide photographic light-sensitive material as claimed in claim 1, wherein D is selected from the group consisting of

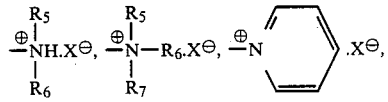

-continued

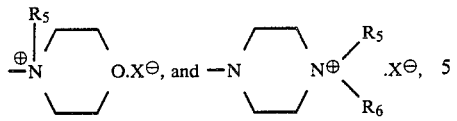

wherein $R_5$, $R_6$ and $R_7$ is each an alkyl group having 1 to 12 carbon atoms, an alkenyl group or a phenyl group, and X is selected from the group consisting of OH, Cl, Br, I, $NO_3$, $CH_3COO$,

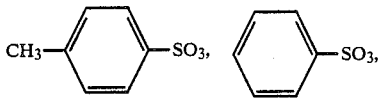

$CH_3SO_3$, $(SO_4)_{\frac{1}{2}}$ and polybasic carboxylic acid radicals.

10. The silver halide photographic light-sensitive material as claimed in claim 1, wherein D is selected from the group consisting of

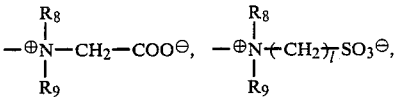

-continued

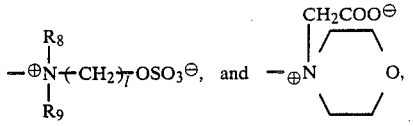

wherein $R_8$ and $R_9$ each represents a hydrogen atom, an alkyl group having 1 to 12 carbon atoms, an alkenyl group and a phenyl group and l represents 1 to 6.

11. The silver halide photographic light-sensitive material as claimed in claim 1, wherein D is selected from the group consisting of a hydrogen atom, a substituted or unsubstituted alkyl group having 1 to 24 carbon atoms an alkenyl group, an aryl group and an acyl group.

12. The silver halide photographic light-sensitive material as claimed in claim 1, wherein said another layer is selected from the group consisting of a surface protective layer, a back layer, an intermediate layer and an undercoat layer.

13. The silver halide photographic light-sensitive material as claimed in claim 1, wherein said surface active agent is employed in an amount of from 0.0001 to 2.0 g per square meter of the photographic light-sensitive material.

14. The silver halide photographic light-sensitive material as claimed in claim 13, wherein said surface active agent is employed in an amount of from 0.0005 to 0.05 g per square meter of the photographic light-sensitive material.

* * * * *